US007993222B2

(12) United States Patent
Siow

(10) Patent No.: US 7,993,222 B2
(45) Date of Patent: Aug. 9, 2011

(54) TABLE-TENNIS BAT(PEN-HOLDING TYPE)

(76) Inventor: Chong Peen Siow, Singapore (SG)

( * ) Notice: Subject to any disclaimer, the term of this patent is extended or adjusted under 35 U.S.C. 154(b) by 195 days.

(21) Appl. No.: 11/292,119

(22) Filed: Dec. 2, 2005

(65) Prior Publication Data

US 2006/0084533 A1 Apr. 20, 2006

(51) Int. Cl.
*A63B 59/04* (2006.01)

(52) U.S. Cl. ..... 473/527

(58) Field of Classification Search ..... 473/526, 473/527, 529

See application file for complete search history.

(56) References Cited

U.S. PATENT DOCUMENTS

| | | | | |
|---|---|---|---|---|
| 703,911 | A * | 7/1902 | Girdwood | 473/526 |
| 2,147,110 | A * | 2/1939 | Schmid | 473/526 |
| D164,883 | S * | 10/1951 | Schmid | D21/731 |
| 2,640,698 | A * | 6/1953 | Forsyth | 473/529 |
| 5,312,101 | A * | 5/1994 | McDaniel | 473/526 |
| 5,816,958 | A * | 10/1998 | Seymour | 473/526 |
| 2003/0013564 | A1* | 1/2003 | McDaniel | 473/527 |
| 2006/0084533 | A1* | 4/2006 | Siow | 473/524 |

FOREIGN PATENT DOCUMENTS

| | | | |
|---|---|---|---|
| DE | 44 30 476 A1 | * | 3/1995 |
| JP | P2001-112900 A | * | 4/2001 |
| JP | 2003-325715 | * | 11/2003 |

* cited by examiner

*Primary Examiner* — Raleigh W. Chiu
(74) *Attorney, Agent, or Firm* — Siow Chong Peen

(57) ABSTRACT

The inventions published consist of 'split-level step' between bat handle and contact section. This said step provides the newly inventions here the concept of critical holding points (called as C.H.P.)for the thumb, forefinger and any of other three fingers. These fingers can grip firmly onto the said step. This allows better swing of the bat, angle control, flexibility of bat manipulation and power. These C.H.P. also provides the proper gripping areas so that finger deformation problem is less likely to happen.

In addition, it is less strainuous physically for the wrist and fingers, so the better power and performance of the players can be maintained longer naturally throughout the games.

Besides, the invented C.H.P.concept can also be achieved (although it is less ideal compared to the 'split level Step') without adopting the 'split-level step'(that is with the bend/ joint angle between the split level equals zero degree) by having 'raised-height-block' or raised step or 'prolonged bottom handle' front and/or at the back of the bat (see Y & Z in FIGS. 3,4,5,6 & 7) so as to act as the C.H.P. as found in the split-leveled step (see X in FIGS. 2,4 & 7) (Note: to use drawing 7 for article publication purpose).

3 Claims, 7 Drawing Sheets

STEPPED HANDLE DESIGN COMPRISES OF STEPPED HANDLE PLANE (X) - CHP FEARURES (X)

FIGURE 1 -PRIOR ART

STEPPED HANDLE DESIGN COMPRISES OF STEPPED HANDLE PLANE (X) - CHP FEARURES (X)

STEPPED HANDLE DESIGN COMPRISES OF RAISED HEIGHT BLOCKS/STRIPS-CHP FEATURES (X)

STEPPED HANDLE DESIGN COMPRISES OF STEPPED HANDLE PLANE (X) AND PROLONGED BOTTOM HANDLE (Z)- CHP FEARURES (X)

STEPPED HANDLE DESIGN COMPRISES OF PROLONGED BOTTOM HANDLE (Z)- CHP FEATURES (X)

STEPPED HANDLE DESIGN COMPRISES OF PROLONGED BOTTOM HANDLE WITH THICKER END PORTION-CHP FEATURES (X)

STEPPED HANDLE DESIGN COMPRISES OF STEPPED HANDLE PLANE (X)/PROLONGED BOTTOM HANDLE (Z) WITH THICKER END PORTION- CHP FEATURES (X)

TABLE-TENNIS BAT(PEN-HOLDING TYPE)

TECHNICAL FIELD

The present innovation relates to pen-holding type of table-tennis bat.

BACKGROUND ART

The existing pen-holding-table tennis bats are made as shown in FIG. 1. (the literature here below all refers to pen-holding table tennis bats) These bats are not ergonomics enough for firm holding and flexibility for good exertion of wrist and finger strengths for better power and performance of the players.

This is due to insufficient firm and critical holding points on the bat for the exertion of wrist and finger power. This reduces the power of the play and also at times causes more possible deformation of the finger (eg: the middle finger is 'bent' and deformed slightly) due to exertion of finger strength onto the bat without proper holding points on the bat.

The new invention shown here consists of a 'split-level step' between bat handle and contact section (bat contact section here refers to the section of the bat where the rubber is adhered to). This means that either one of the plane of the handle and the contact section is higher than the other (see FIG. 2). This is improved from existing old design where both sections are made in the same plane. This said step (see 'x' in FIG. 2) provides the new invention and concept of 'critical holding points' (so called 'C.H.P.' in the following literature) for thumb, forefinger and any of other three fingers. These fingers can grip firmly onto the said step. This allows better swing of the bat, angle control, flexibility of bat manipulation and power. These C.H.P also provides the proper gripping areas for finger rest so that finger deformation problem is less likely to happen.

In addition, due to this invention of the good C.H.P., it is less strainuous physically for the wrist and fingers, so better power and performance of the players can be maintained longer naturally through out the game.

In addition to the published new invention of 'split-level step', the C.H.P. concept can be achieved (although it is less ideal compared to the 'split level step' design) without adopting the 'split-level step' by having 'raised height'-block or step or 'prolonged bottom handle' design in front and/or at the back of the bat (See Y&X in FIGS. 3,4,5,6&7) acting as the C.H.P. as found in the 'split-level step'. (see X in FIGS. 2,4&7). These 'raisedheight' blocks or steps and 'prolonged bottom handle' are also claimed and published here as the new design or invention here. (see under 'Claims')

SUMMARY OF EIGHT DIFFERENT EMBODIMENT OF C.H.P

Summary of 8 different embodiment of the C.H.P adopting the split level step (X), prolonged bottom handle and raised height blocks are as below:

(1) The bat comprises of a flat planar section ('U') with a handle ('V') integrally joined to the said flat planar section wherein two different planes with a split-level step ('X' in FIG. 7) in such a manner that a prolonged bottom handle piece ('Z') with tapered and thicker curved portion (or of any shapes or forms) at one end, stretching from the handle section towards the flat planar section forming the raised bottom step (X), is used to act as holding points for all or any of the middle, fourth and little fingers can press firmly against the the thumb and forefinger from bottom and top (at 'X') respectively towards the centerline of the said flat planar and/or handle and/or joint section.

(2) The bat comprises of a flat planar section ('U') with a handle ('V') integrally joined to the said flat planar section wherein two different planes with a split-level step ('X' in FIG. 2) in such a manner that single or multiple 'raised-height-blocks' ('Y') of any forms or shapes at the bottom side of the flat planar section forming the raised bottom step (X) are used to act as 1 holding points where all or any of the middle, fourth and little fingers can press firmly against the the thumb and forefinger from bottom and top (at 'Y') respectively towards the centerline of the said flat planar and/or handle and/or joint section.

(3) The bat comprises of a flat planar section ('U') with a handle (V') integrally joined to the said flat planar section wherein two different planes with a split-level step ('X' in FIG. 2) forming the raised bottom step (X) in such a manner that the joining portion between the handle and flat planar section forms an integral or joined part of the handle portion in a 45 degree or any other inclination angle slope or step of any forms in which the slope itself provides the unique critical holding points where all or any of the middle, fourth and little fingers can press firmly against the the thumb and forefinger bottom and top (at 'X') respectively towards the centerline of the said flat planar and/or handle and/or joint.

(4) The bat comprises of a flat planar section ('U') with a handle ('V') integrally joined to the said flat planar section wherein two different planes with a split-level step ('X' in FIG. 4) forming the raised bottom step (X) in such a manner that a prolonged bottom handle piece ('Z') without any tapered and thicker curved portion (or of any shapes or forms) stretching from the handle section towards the flat planar section, can be used to act as holding points where all or any of the middle, fourth and little fingers can press firmly against the the thumb and forefinger bottom and top (at 'Z') respectively towards the centerline of the said flat planar and/or handle and/or joint.

(5) A bat comprises of a flat planar section ('U') with a handle ('V') integrally joined to the said flat planar section in the same plane (where the split-level step joint/bend angle is zero degree) in such a manner that a prolonged bottom handle piece ('Z' in FIG. 6) with tapered and thicker curved portion (or of any shapes or forms) at one end, forming the raised bottom step (X), stretching from the handle section towards the flat planar section is used to act as critical holding points where all or any of the middle, fourth and little fingers can press firmly against the the thumb and forefinger from bottom and top (at 'Z') respectively towards the centerline of the said flat planar and/or handle and/or joint.

(6) A bat comprises of a flat planar section ('U') with a handle ('V') integrally joined to the said flat planar section in the same plane (where the split-level step joint/bend angle is zero degree) in such a manner that single or multiple 'raised-height-blocks' ('Y' in FIG. 3) of any forms or shapes at the bottom side of the flat planar section, forming the raised bottom step (X), are used to act as holding points where all or any of the middle, fourth and little fingers can press firmly against the the thumb and forefinger from bottom and top (at 'Y') respectively towards the centerline of the said flat planar and/or handle and/or joint.

(7) A bat comprises of a flat planar section ('U') with a handle ('V') integrally joined to the said flat planar section in the same plane (where the split-level step joint/bend angle is zero degree in such a manner that a prolonged bottom handle piece ('Y' in FIG. 5) without any tapered and thicker curved portion (or of any shapes or forms), forming the raised bottom step (X) stretching from the handle section towards the flat planar section, can be used to act as holding points where all or any of the middle, fourth and little fingers can press firmly against the thumb and forefinger from bottom and top (at 'Z') respectively towards the centerline of the said flat planar and/or handle and/or joint.

(8) A bat comprises of a flat planar section ('U')with a handle ('V') integrally joined to the said flat planar section in the same (split-level step with zero degree bend/joint) or different plane forming the raised bottom step X (split level-step with 45 or any other angle bend/joint) in such a manner that features like a 'split-level step' ('X'), a prolonged bottom handle piece ('Z') or a raised-height block or blocks ('Y') at the bottom of the bat surface or combination of all or some of the said features constitute the raised bottom step (X) where all or any of the middle, fourth and little fingers can press firmly against the thumb and forefinger from bottom and top (at 'X', 'Z' or 'Y') respectively towards the centerline of the said flat planar and/or handle and/or joint.

BRIEF DESCRIPTION OF FIGS. 1,2,3,4,5,6 AND 7

Figure 1:
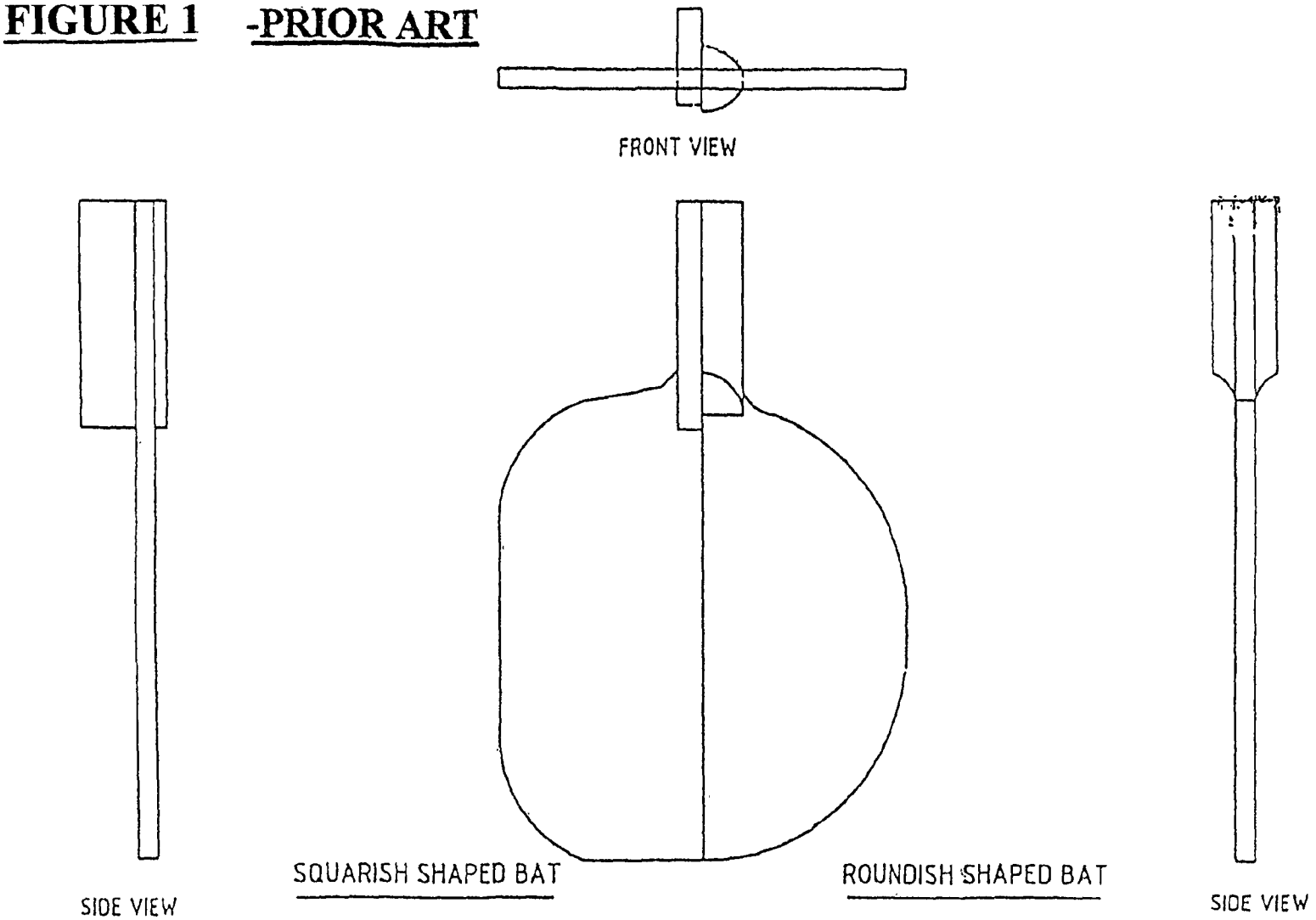
FIG. 1 shows front and side view of a traditional table-tennis bat
Figure 2:
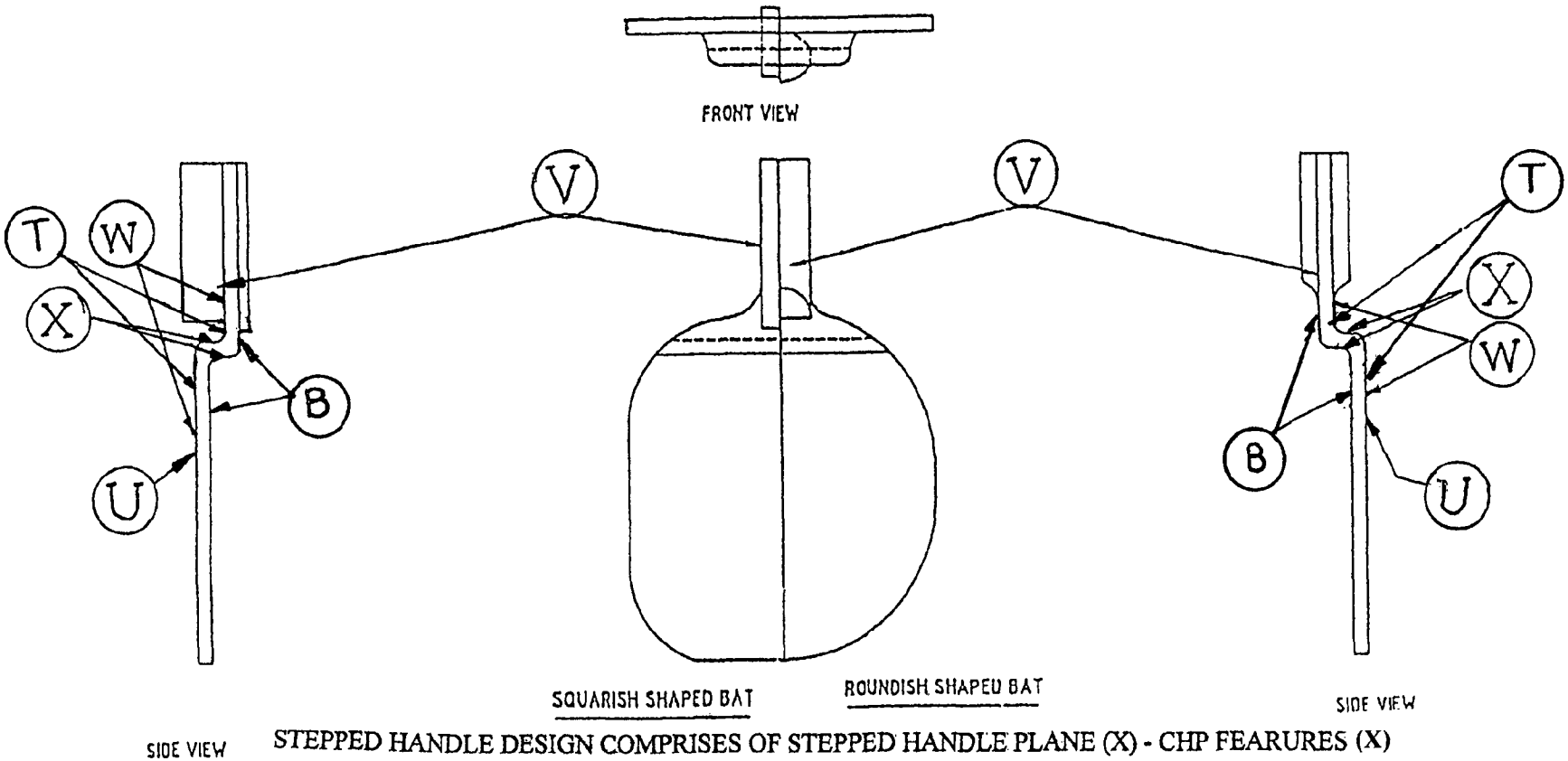
FIG. 2 shows front and side view of split-level step feature
Figure 3:
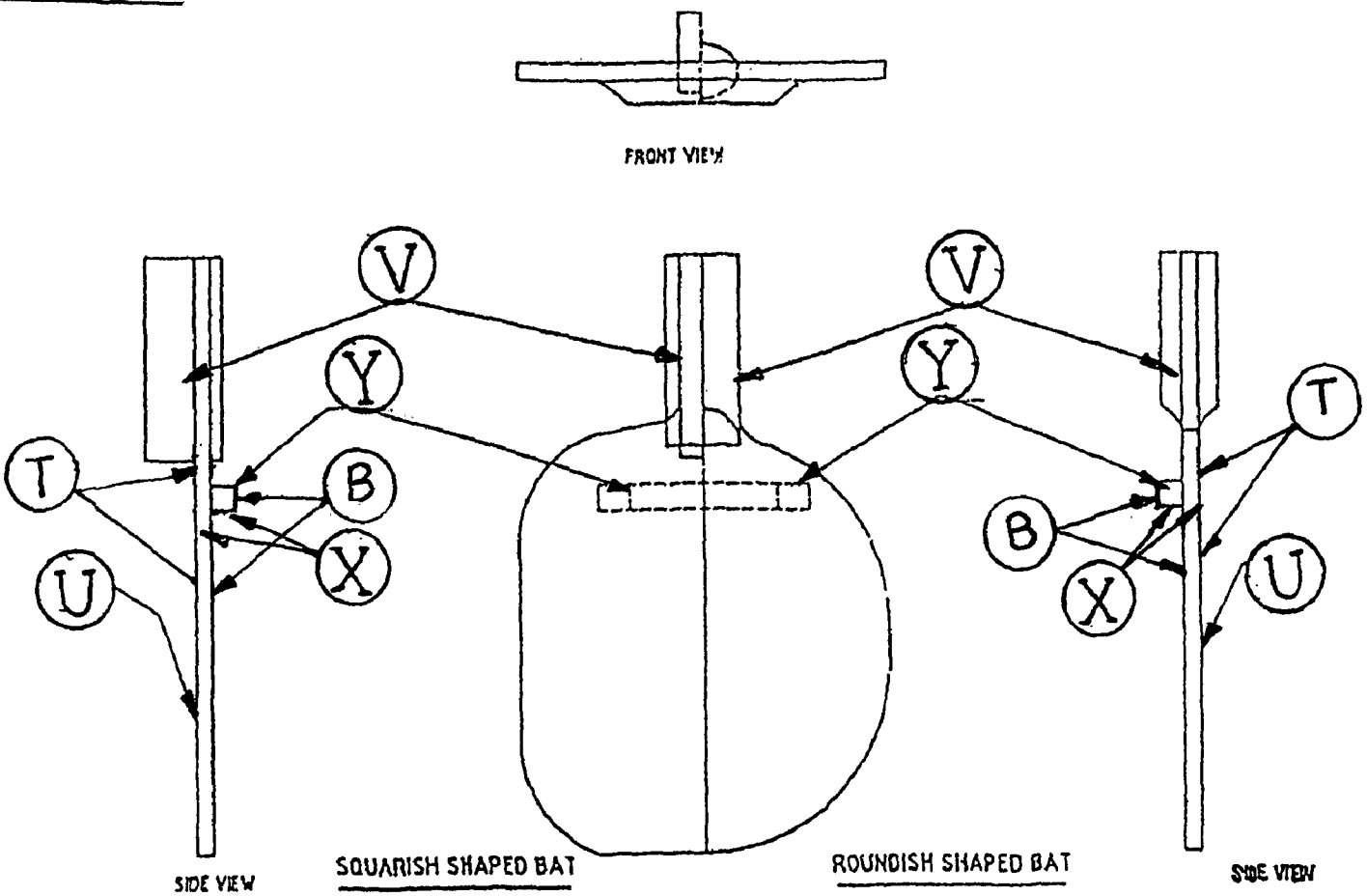
FIG. 3 shows front and side view of raised height block feature
Figure 4:
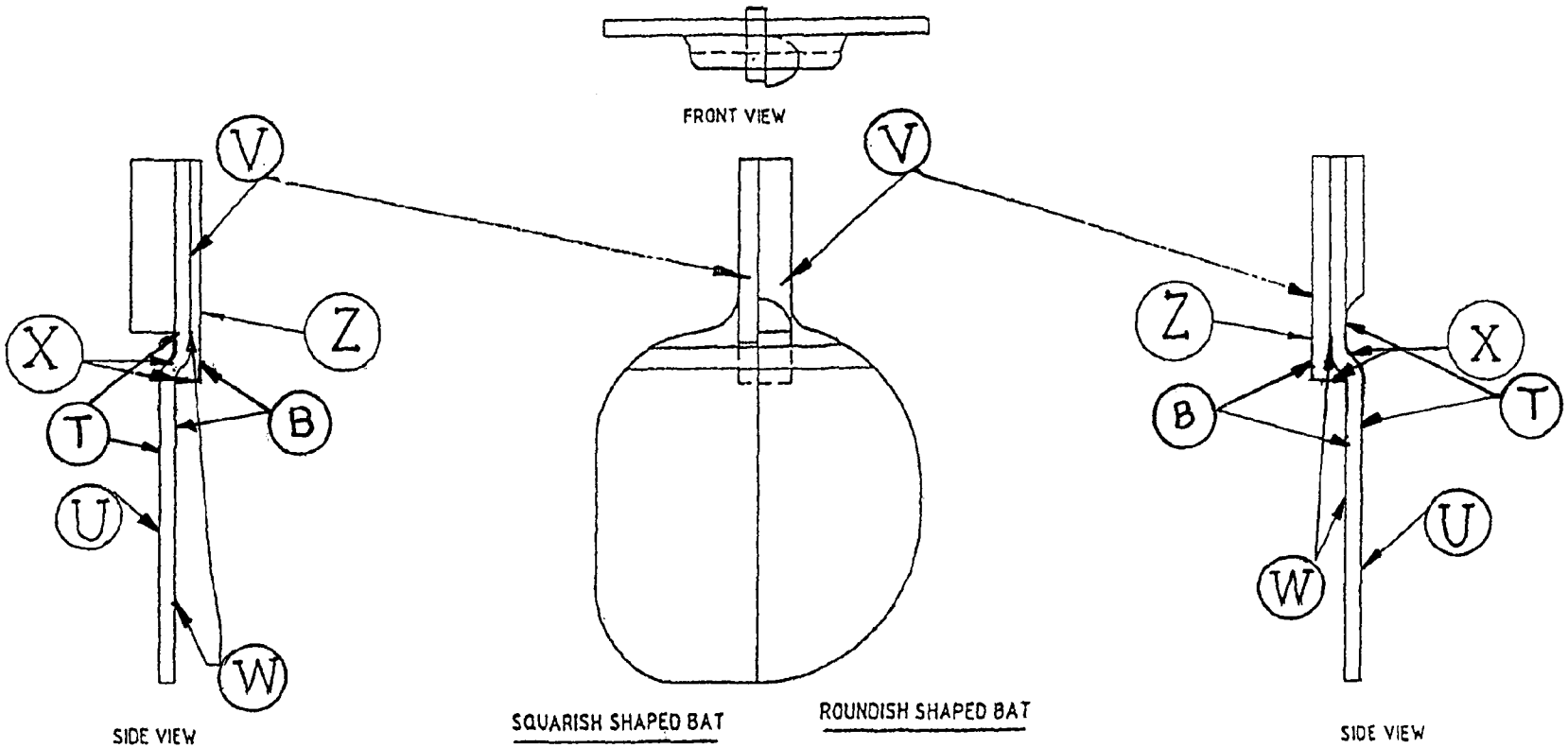
FIG. 4 shows front and side view of split level step with prolonged botton handle feature
Figure 5:
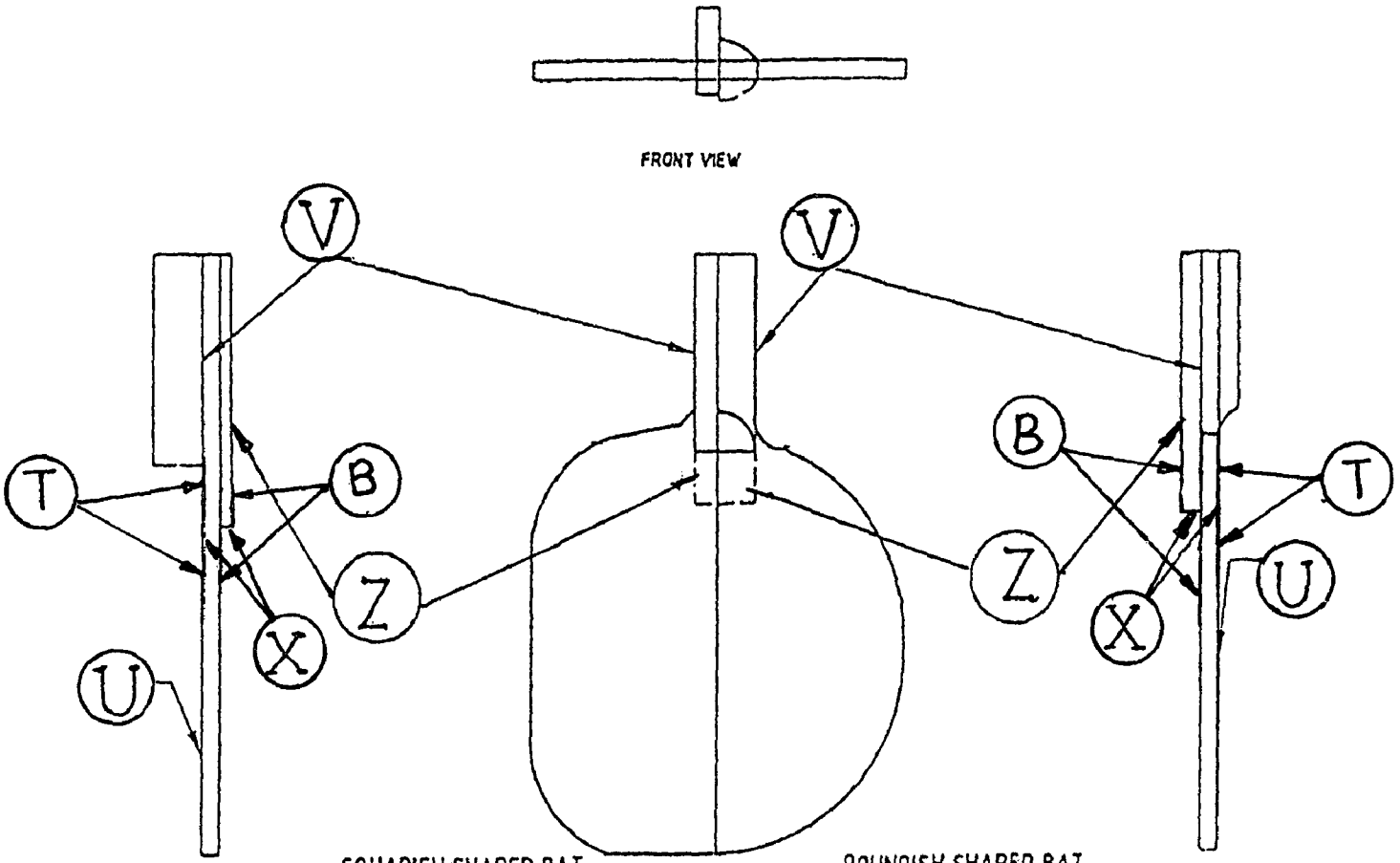
FIG. 5 shows front and side view of prolonged bottom handle feature (without thicker curved portion)
Figure 6:
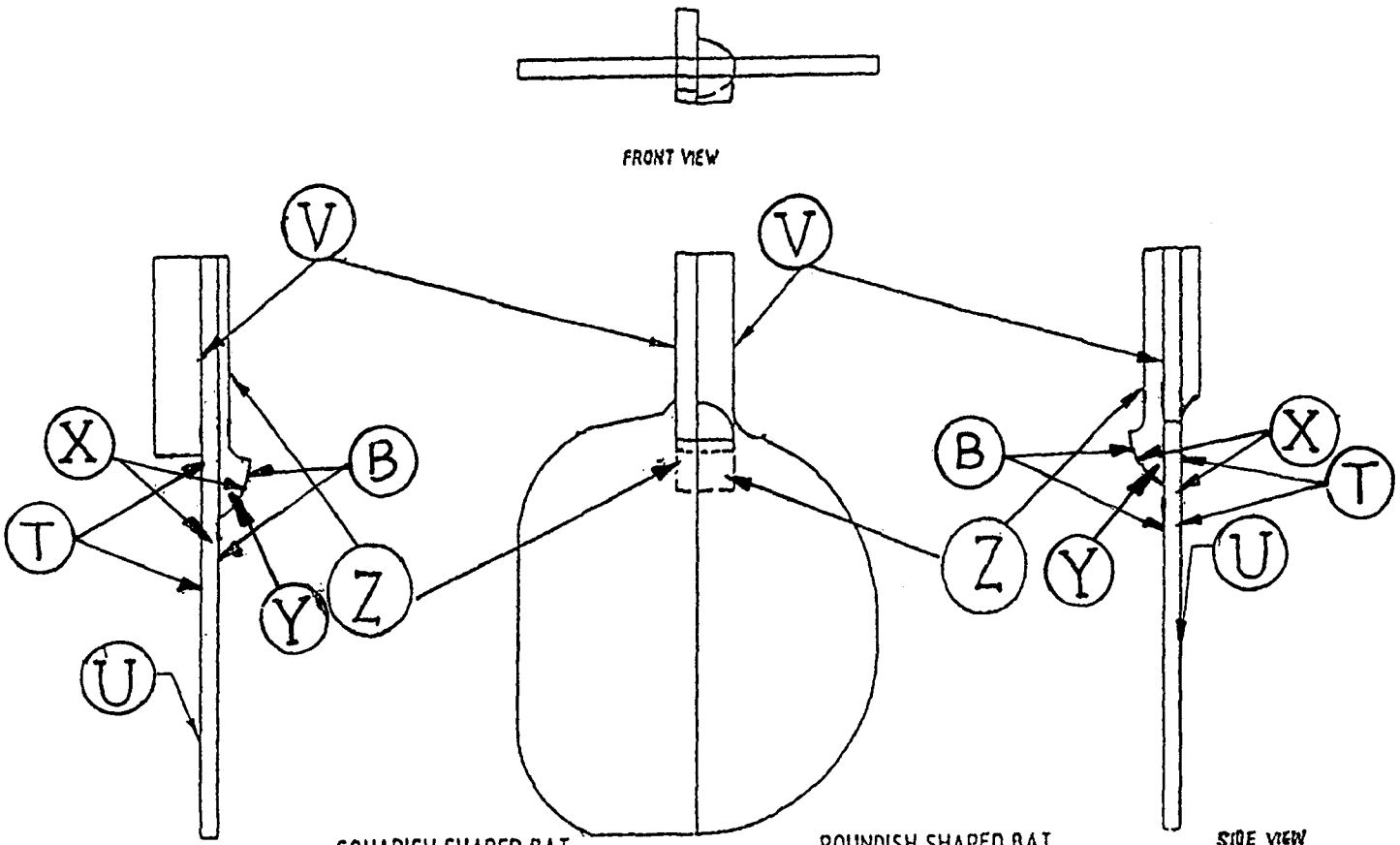
FIG. 6 shows front and side view of prolonged bottom handle feature (with thicker curved portion)
Figure 7:
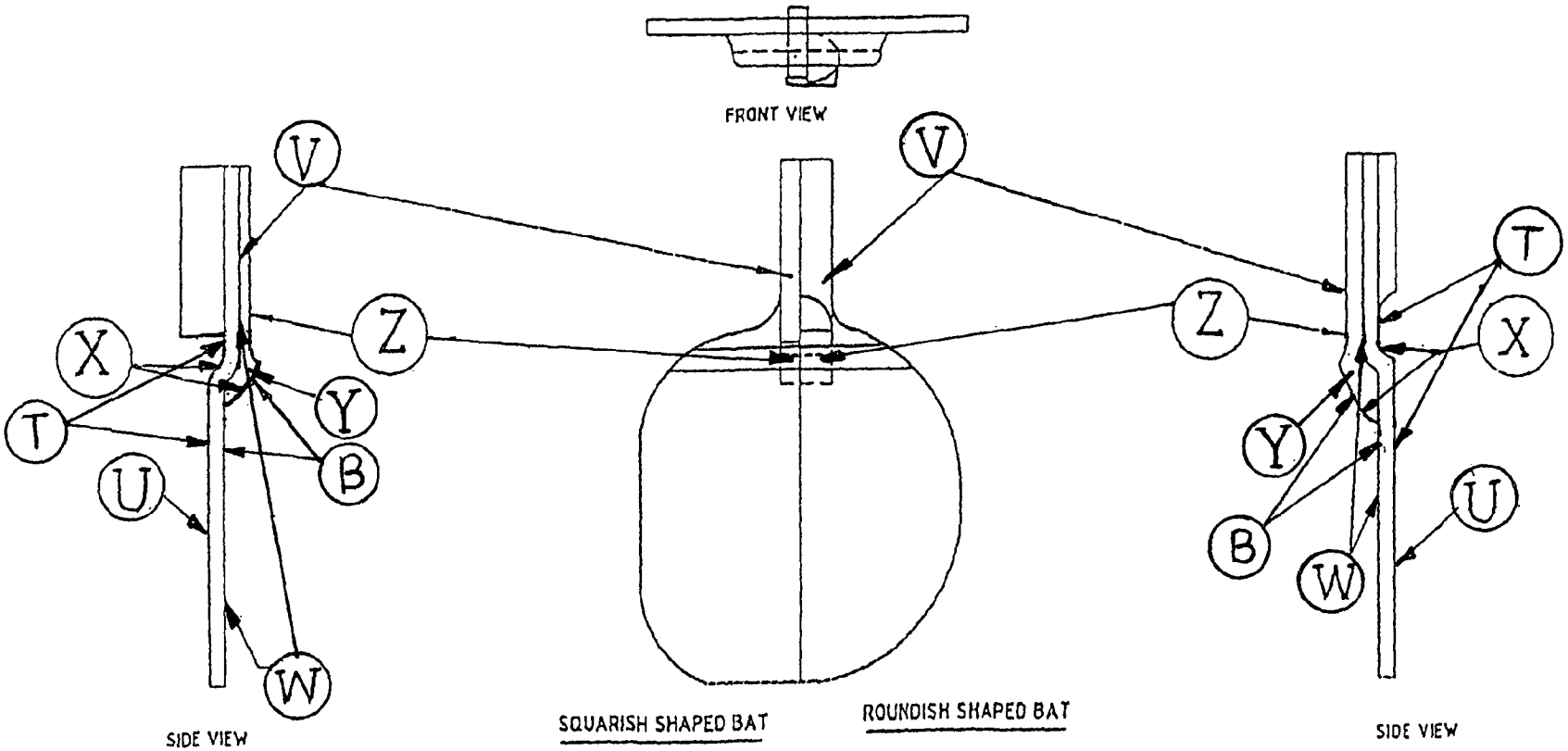
FIG. 7 shows front and side view of split level step with prolonged bottom handle

DETAILED DESCRIPTION OF FIGS. 2,3,4,5,6 and 7

'u' means 'contact surface'

'v' means 'handle section'

'w' means 'split-level step' between handle and contact section with 45 degrees or any other angles (this step becomes single-level step without split-level when the angles becomes zero degree)

'x' means 'bend or step or joint' with 45 degrees or any other angles or zero degree.

'y' means 'raised-height block or strip'

'z' means 'prolonged or lengthen bottom handle'.

The invention claimed is:

1. A pen-holding style bat for playing table tennis comprising: a flat planar ball-striking portion(U) having a top forehand surface (T)and a bottom backhand surface(B); a handle (V)having a top forehand surface(T) and bottom backhand surface(B); wherein, the said handle contains a raised bottom step (X)extending over the said bottom backhand surface of the said handle and from the joint located between the said planar ball-striking portion and said handle and at the proximity of the tip of the extended middle finger while the said bat is being gripped.

2. The bat according to claim (1) wherein the handle (V) is integrally joined to the said flat planar ball-striking portion (U) such that the said handle consists of two distinct planes linked together by a step embodying the said raised bottom step (X) extending over the bottom handle surface(B) of the said handle to the joint located between the said flat planar ball-striking portion and said handle and at the proximity of the tip of the extended middle finger while the said bat is being gripped.

3. The bat according to claim (1) wherein the handle (V) further comprises of a raised bottom piece(Y) embodying the said raised bottom step (X), attached to and extending over the said bottom backhand surface (B) of the said handle and from the joint located between the said flat planar ball-striking portion and said handle and at the proximity of the tip of the extended middle finger while the said bat is being gripped.

* * * * *